US010806246B1

(12) United States Patent
Chen

(10) Patent No.: US 10,806,246 B1
(45) Date of Patent: Oct. 20, 2020

(54) RETAINERS AND FOLDABLE TABLE HAVING SAME

(71) Applicant: Inno-Sports Co., Ltd., Xiamen (CN)

(72) Inventor: Renhua Chen, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 0 days.

(21) Appl. No.: 16/839,337

(22) Filed: Apr. 3, 2020

(30) Foreign Application Priority Data

Sep. 30, 2019 (CN) ..... 2019 2 1661873 U

(51) Int. Cl.
*A47B 3/00* (2006.01)
*A47B 3/08* (2006.01)
*A47B 3/087* (2006.01)

(52) U.S. Cl.
CPC ..... *A47B 3/0815* (2013.01); *A47B 3/087* (2013.01); *A47B 2003/0827* (2013.01)

(58) Field of Classification Search
CPC ..... Y10T 292/096; Y10T 292/0995; Y10T 403/32483; Y10T 403/32508; Y10T 403/595; Y10T 16/54024; Y10T 16/540247; Y10T 16/524; Y10T 403/7176; Y10T 24/304; Y10T 24/309; Y10S 292/17; Y10S 292/63; A47B 3/0915; A47B 3/0818; A47B 3/083; A47B 3/0916; A47B 3/0917; A47B 3/0918; A47B 3/0815; A47B 3/0913; A47B 3/087; E04H 15/48; E04H 15/50; E04H 15/46
USPC ..... 248/407, 408, 409, 423, 439, 188.6; 108/115, 160, 126, 129–133, 162, 108/166–169, 171–174, 176, 179, 902; 135/121, 126, 128–131, 140, 144, 146, 135/120.3
See application file for complete search history.

(56) References Cited

U.S. PATENT DOCUMENTS 1,063,642 A 6/1913 Birdsell
2,136,569 A 11/1938 Trimpi
2,803,033 A * 8/1957 Rachman ..... F16C 11/04 16/326
2,803,050 A * 8/1957 Fernberg ..... F16B 2/245 403/188

(Continued)

FOREIGN PATENT DOCUMENTS

CA 2971886 * 12/2018
DE 29515948 * 1/1996

(Continued)

*Primary Examiner* — Janet M Wilkens
(74) *Attorney, Agent, or Firm* — Morgan, Lewis & Bockius LLP

(57) ABSTRACT

A table includes a frame and a tabletop coupled with the frame. The frame includes first and second longitudinal bars, each having first and second bars pivotally connected with each other. The tabletop includes a first panel and a second panel. The first panel is coupled with the first bars of the first and second longitudinal bars. The second panel is coupled with the second bars of the first and second longitudinal bars. The tabletop also include one or more first retainers integrally formed or coupled with the first panel and one or more second retainers integrally formed or coupled with the second panel. When the first and second panels are folded onto each other, the first and second retainers engage with each other and lock the table in the folded state.

20 Claims, 13 Drawing Sheets

(56) References Cited

U.S. PATENT DOCUMENTS 2,868,599 A * 1/1959 Roggio ..... A47B 3/087 108/36
3,075,809 A 1/1963 Wilson
3,187,373 A * 6/1965 Fisher ..... E05D 11/1007 16/324
3,368,504 A 2/1968 Cohen
3,410,232 A 11/1968 Bills
3,410,327 A * 11/1968 Ausnit ..... B65D 33/2541 383/65
3,861,328 A * 1/1975 Lawless ..... A47B 19/06 108/115
4,191,111 A 3/1980 Emmert
4,285,105 A * 8/1981 Kirkpatrick ..... B65D 33/255 206/459.1
4,561,108 A * 12/1985 Kamp ..... B65D 33/2541 383/63
4,792,240 A * 12/1988 Ausnit ..... B65D 33/2541 24/DIG. 50
5,325,794 A 7/1994 Hontani
5,483,710 A * 1/1996 Chan ..... A47D 13/063 16/325
5,745,954 A * 5/1998 Shogan ..... A47D 13/063 16/326
5,857,229 A * 1/1999 Magnani, Jr. ..... A47D 13/063 16/323
6,223,366 B1 * 5/2001 Cheng ..... A47D 13/063 16/326
6,363,550 B1 * 4/2002 Wang ..... A47D 13/063 403/102
6,508,262 B1 1/2003 Takayama
6,843,183 B2 1/2005 Strong
6,971,321 B1 * 12/2005 Strong ..... A47B 3/091 108/132
7,059,254 B2 6/2006 Strong et al.
7,096,799 B2 8/2006 Strong et al.
7,097,380 B2 8/2006 Lee
7,171,910 B2 2/2007 Neunzert et al.
7,260,871 B2 * 8/2007 Borchardt ..... B65D 33/2541 24/399
7,428,872 B2 9/2008 Strong et al.
7,475,643 B2 1/2009 Haney et al.
7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,874,303 B2 1/2011 Xie
8,006,630 B2 8/2011 Strong et al.
8,033,228 B2 10/2011 Haney et al.
8,042,475 B2 10/2011 Larcom et al.
8,113,130 B2 * 2/2012 Leng ..... A47B 3/0913 108/132
8,156,875 B2 4/2012 Neunzert et al.
8,302,541 B2 11/2012 Haney et al.
8,342,107 B2 1/2013 Mover et al.
8,534,205 B1 9/2013 Johnson et al.
8,578,865 B2 11/2013 Haney et al.
8,622,007 B2 1/2014 Peery et al.
8,746,155 B2 6/2014 Haney et al.
8,757,069 B2 6/2014 Peery et al.
8,904,943 B2 * 12/2014 Jin ..... A47B 3/0818 108/127
9,027,952 B2 5/2015 Zhu
9,103,368 B2 * 8/2015 Mendes ..... F16C 11/10
D748,418 S 2/2016 Johnson et al.
9,277,808 B2 * 3/2016 Cai ..... A47B 3/0912
9,282,812 B2 * 3/2016 Chang ..... A47B 3/0818
D756,694 S 5/2016 Johnson et al.
9,351,563 B2 5/2016 Bennett et al.
10,470,561 B2 11/2019 Clegg et al.
2003/0089286 A1 5/2003 Wang
2005/0005826 A1 * 1/2005 Strong ..... A63B 63/083 108/132
2005/0097829 A1 5/2005 Seo
2005/0241550 A1 * 11/2005 Neunzert ..... A47B 3/00 108/129
2005/0279260 A1 * 12/2005 Stanford ..... A47B 13/021 108/115
2006/0062632 A1 3/2006 Jang
2006/0196395 A1 * 9/2006 Lin ..... A47B 3/087 108/132
2007/0079441 A1 * 4/2007 Chen ..... A47D 13/063 5/99.1
2008/0078310 A1 4/2008 VanNimwegen
2013/0000528 A1 * 1/2013 Jin ..... A47B 3/0915 108/127
2013/0025509 A1 * 1/2013 Jin ..... A47B 3/0818 108/166
2013/0233210 A1 * 9/2013 Jin ..... A47B 3/0818 108/166
2014/0030012 A1 1/2014 Lee
2014/0070070 A1 * 3/2014 Shinoda ..... F16L 3/02 248/634
2014/0099155 A1 4/2014 Chen
2014/0130837 A1 * 5/2014 Sy-Facunda ..... E04H 15/50 135/120.3
2016/0348395 A1 * 12/2016 Jin ..... E04H 15/26
2017/0013955 A1 1/2017 Lin
2018/0153302 A1 6/2018 Jiang
2019/0150608 A1 5/2019 Johnson et al.
2019/0284831 A1 9/2019 Volin
2019/0292808 A1 9/2019 Dotterweich
2020/0029684 A1 * 1/2020 Jiang ..... A47C 7/624

FOREIGN PATENT DOCUMENTS

EP 1492432 B1 10/2016
WO WO 2013000149 A1 3/2013

* cited by examiner

RETAINERS AND FOLDABLE TABLE HAVING SAME

CROSS-REFERENCE TO RELATED APPLICATIONS

The present application claims priority to Chinese Utility Model Application CN 201921661873.1 filed Sep. 30, 2019. The disclosure of the application is incorporated herein for all purposes by reference in its entirety.

FIELD OF THE INVENTION

The present invention generally relates to tables, and in particular to retainers, folding/unfolding mechanisms, and foldable tables.

BACKGROUND

Most of existing tables are not foldable. Some of existing tables are foldable but require assembling by end users. Of existing tables, tabletops and supporting legs are usually packaged separately. They are inconvenient for transportation and storage. Moreover, they require assembling of the tabletops and the legs by end users, which are usually time consuming and sometimes difficult and unmanageable.

Given the current state of the art, there remains a need for control mechanisms, frames and tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides tables capable of being folded in half. A table generally includes a frame and a tabletop coupled with the frame and supported by the frame when in use. The frame includes a first longitudinal bar, a second longitudinal bar, a first lateral bar and a second lateral bar. The first longitudinal bar is disposed at a first side of the table. The second longitudinal bar is disposed at a second side of the table and substantially parallel to the first longitudinal bar. Each of the first and second longitudinal bars includes a first bar and a second bar pivotally connected with each other. The first lateral bar is disposed at a third side of the table and has a first end pivotally connected with the first longitudinal bar and a second end pivotally connected with the second longitudinal bar. The second lateral bar is disposed at a fourth side of the table and has a first end pivotally connected with the first longitudinal bar and a second end pivotally connected with the second longitudinal bar. The tabletop includes a first panel, a second panel, one or more first retainers, and one or more second retainers. The first panel is coupled with the first bars of the first and second longitudinal bars. The second panel is coupled with the second bars of the first and second longitudinal bars. The one or more first retainers are integrally formed or coupled with the first panel at the third side of the table, each including a first receiving portion and a first engaging portion. The one or more second retainers are integrally formed or coupled with the second panel at the fourth side of the table, each including a second receiving portion and a second engaging portion. The first receiving portion of each first retainer receives cross-section-wise the first lateral bar of the frame.

The second receiving portion of each second retainer receives cross-section-wise the second lateral bar of the frame. When the table is in a folded state, the first engaging portion of each respective first retainer in the one or more first retainers engages with the second engaging portion of a corresponding second retainer in the one or more second retainers, thereby retaining the table in the folded state.

In various exemplary embodiments, the respective first retainer includes a first base and two first lever arms. The first base is integrally formed or coupled with the first panel of the tabletop, and the two first lever arms are extended from the first base. Proximal portions of the two first lever arms collectively form the first receiving portion, and distal portions of the two first lever arms collectively form the first engaging portion. The corresponding second retainer includes a second base and two second lever arms. The second base is integrally formed or coupled with the second panel of the tabletop, and the two second lever arms are extended from the second base. Proximal portions of the two second lever arms collectively form the second receiving portion, and distal portions of the two second lever arms collectively form the second engaging portion.

In some exemplary embodiments, the distal portions of the two first lever arms of the respective first retainer are snap-fitted between the distal portions of the two second lever arms of the corresponding second retainer.

In some exemplary embodiments, the distal portion of each first lever arm includes an outwardly curved end portion or the distal portion of each second lever arm includes a pointed tip portion, thereby facilitating insertion of the distal portions of the two second lever arms of the corresponding second retainer between the distal portions of the two first lever arms of the respective first retainer.

In some exemplary embodiments, the distal portion of each first lever arm includes a concave inner surface and the distal portion of each second lever arm includes a convex outer surface that mates with the concave inner surface of the distal portion of each first lever arm, thereby facilitating retention of the distal portions of the two second lever arms of the corresponding second retainer in between the distal portions of the two first lever arms of the respective first retainer.

In some other exemplary embodiments, the distal portions of the two second lever arms of the corresponding second retainer are snap-fitted between the distal portions of the two first lever arms of the respective first retainer.

In some exemplary embodiments, the distal portion of each second lever arm includes an outwardly curved end portion or the distal portion of each first lever arm includes a pointed tip portion, thereby facilitating insertion of the distal portions of the two first lever arms of the respective first retainer between the distal portions of the two second lever arms of the corresponding second retainer.

In some exemplary embodiments, the distal portion of each second lever arm includes a concave inner surface and the distal portion of each first lever arm includes a convex outer surface that mates with the concave inner surface of the distal portion of each second lever arm, thereby facilitating retention of the distal portions of the two first lever arms of the corresponding first retainer in between the distal portions of the two second lever arms of the respective second retainer.

In some exemplary embodiments, the one or more first retainers include two first retainers disposed spatially along a lateral direction of the table, and the one or more second retainers include two second retainers disposed spatially along the lateral direction of the table.

In various exemplary embodiments, the frame further includes a plurality of first legs and a plurality of second legs. Each first leg in the plurality of first legs has an end fixedly connected with the first lateral bar, and each second leg in the plurality of second legs has an end fixedly connected with the second lateral bar.

In some exemplary embodiments, the frame further includes a plurality of sliders and a plurality of oblique bars. Each slider in the plurality of sliders is slidably coupled with a first leg in the plurality of first legs or a second leg in the plurality of second legs, and is selectively movable along the first or second leg. Each oblique bar in the plurality of oblique bars has a first end pivotally connected with the first or second longitudinal bar, and a second end pivotally connected with a corresponding slider in the plurality of sliders.

In an exemplary embodiment, each slider in the plurality of sliders includes a controller configured to selectively allow the slider to move along the first and second leg or restrict the slider from moving along the first and second leg.

In various exemplary embodiments, the tabletop further includes a third retainer and a fourth retainer. The third retainer is integrally formed or coupled with the first panel to receive cross-section-wise a first leg in the plurality of first legs when the first leg is folded onto the tabletop. The fourth retainer is integrally formed or coupled with the second panel to receive cross-section-wise a second leg in the plurality of second legs when the second leg is folded onto the tabletop.

In some exemplary embodiments, each of the third and fourth retainers includes a base and two lever arms. The base is integrally formed or coupled with the first or second panel, and the two lever arms extended from the base. Each of the two lever arms includes an outwardly curved end portion, thereby facilitating insertion of the first or second leg. At least one lever arm includes an inwardly protruded knob adjacent the outwardly curved end portion, thereby facilitating retention of the first or second leg.

In some exemplary embodiments, the third and fourth retainers are disposed staggered with respect to each other.

In an exemplary embodiment, one of the third and fourth retainers is disposed at the first side of the table and the other of the third and fourth retainers is disposed at the second side of the table.

In various exemplary embodiments, for at least one of the first and second longitudinal bars, the first and second bars are pivotally connected with each other by a folding/unfolding mechanism. The ding/unfolding mechanism includes a first coupling piece, a second coupling piece, a third coupling piece, a first rod and a second rod. The first coupling piece is fixed at a proximal end of the first bar and includes a first hole and a first slot above the first hole, wherein the first slot has a closed bottom and an open top. The second coupling piece is fixed at a proximal end of the second bar and includes a second hole and a second slot above the second hole, wherein the second slot has a closed bottom and an open top. The third coupling piece includes a third slot having a closed bottom and a closed top. The first rod passes through the first hole of the first coupling piece, the second hole of the second coupling piece, and the third slot of the third coupling piece, wherein the first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece. The second rod is integrally formed or coupled with a top portion of the third coupling piece, and movable together with the third coupling piece. When the second rod is disposed in both of the first slot of the first coupling piece and the second slot of the second coupling piece, the first and second coupling pieces are restricted from rotating with respect to each other. When the second rod is released from any one of the first slot of the first coupling piece and the second slot of the second coupling piece, the first and second coupling pieces are rotatable with respect to each other.

In some exemplary embodiments, each of the first and second coupling pieces includes a horizontal piece, a first lug at a first side of the horizontal piece and a second lug at a second side of the horizontal piece. The first and second lugs are substantially parallel to each other. Each of the first and second lugs is formed with a corresponding first or second hole and a corresponding first or second slot.

In some exemplary embodiments, the third coupling piece includes a third hole, wherein the second rod is coupled with the third coupling piece by passing through the third hole of the third coupling piece.

In some exemplary embodiments, the folding/unfolding mechanism further includes an elastic member disposed in an interior of the third coupling piece between the first rod and a bottom cover of the third coupling piece. The elastic member exerts a force on the first rod and the bottom cover of the third coupling piece, thereby positioning the third coupling piece at the second position where the first rod is at the top of the third slot of the third coupling piece.

The tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
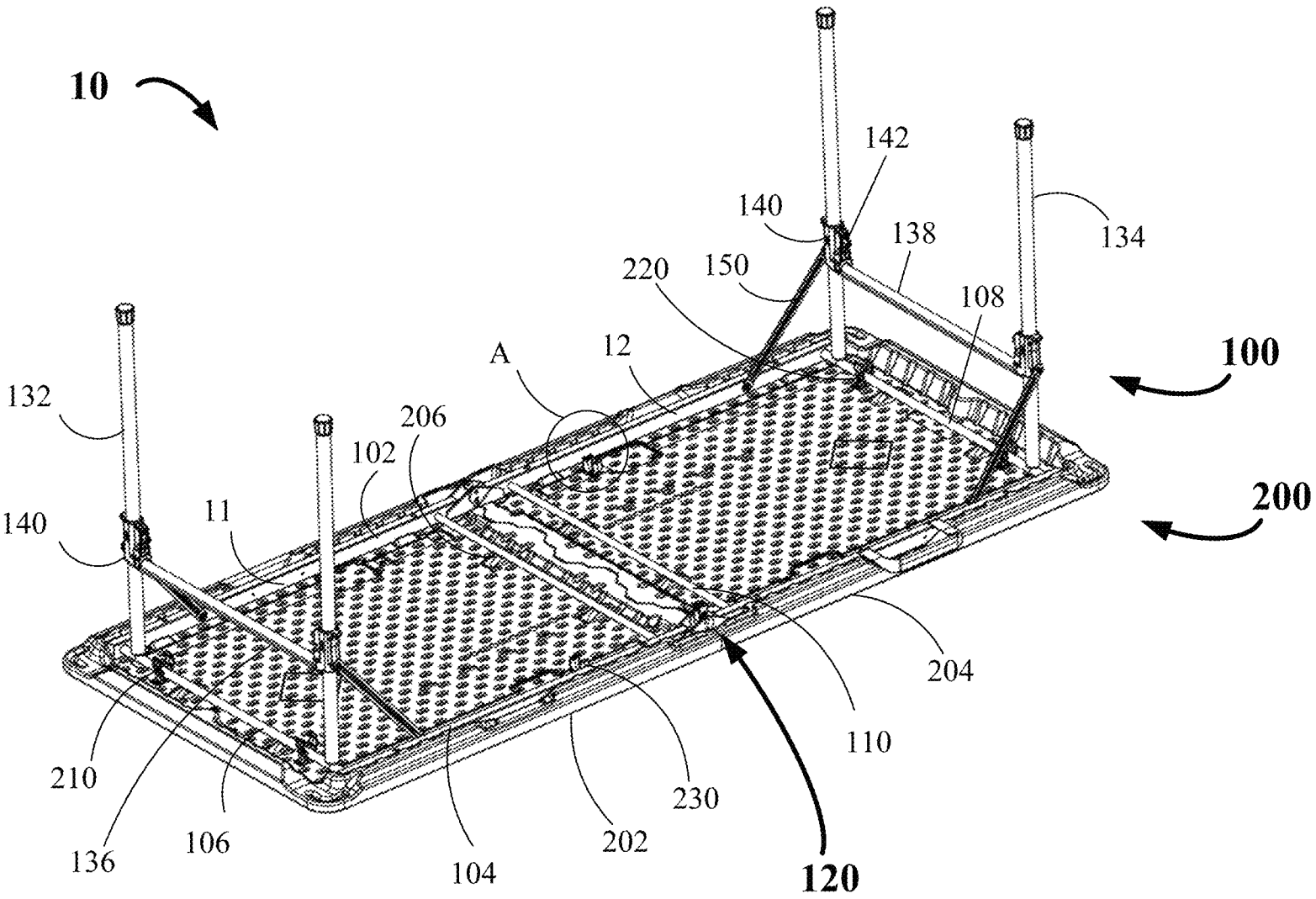
FIG. 1 is a bottom perspective view illustrating an exemplary table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementations of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of tables capable of being folded in half. The tables of the present disclosure can be of various sizes. For instance, a table of the present disclosure can be a coffee table, a dining table, or the like, and can be of a square or rectangular shape. They can be made of various materials including but not limited to metals (e.g., iron, steel, and aluminum), plastics and woods.

Referring to FIGS. 1-4, there is depicted an exemplary table in accordance with some embodiments of the present disclosure. As shown, table 10 includes a frame such as frame 100 and a tabletop such as tabletop 200 coupled with the frame and supported by the frame when in use. In some exemplary embodiments, tabletop 200 is made by blow molding and includes one or more hollow interiors.

Frame 100 includes a first longitudinal bar such as first longitudinal bar 102 disposed at a first side of the frame or table. Frame 100 also includes a second longitudinal bar such as second longitudinal bar 104 disposed at a second side of the frame or table and substantially parallel to the first longitudinal bar. It should be noted that the term "side" does not necessarily mean an outmost edge of a frame or an outmost edge of a table. In some exemplary embodiments, each of first longitudinal bar 102 and second longitudinal bar 104 includes a first bar such as first bar 11 and a second bar such as second bar 12 that are pivotally connected with each other at the proximal ends.

Figure 2A:
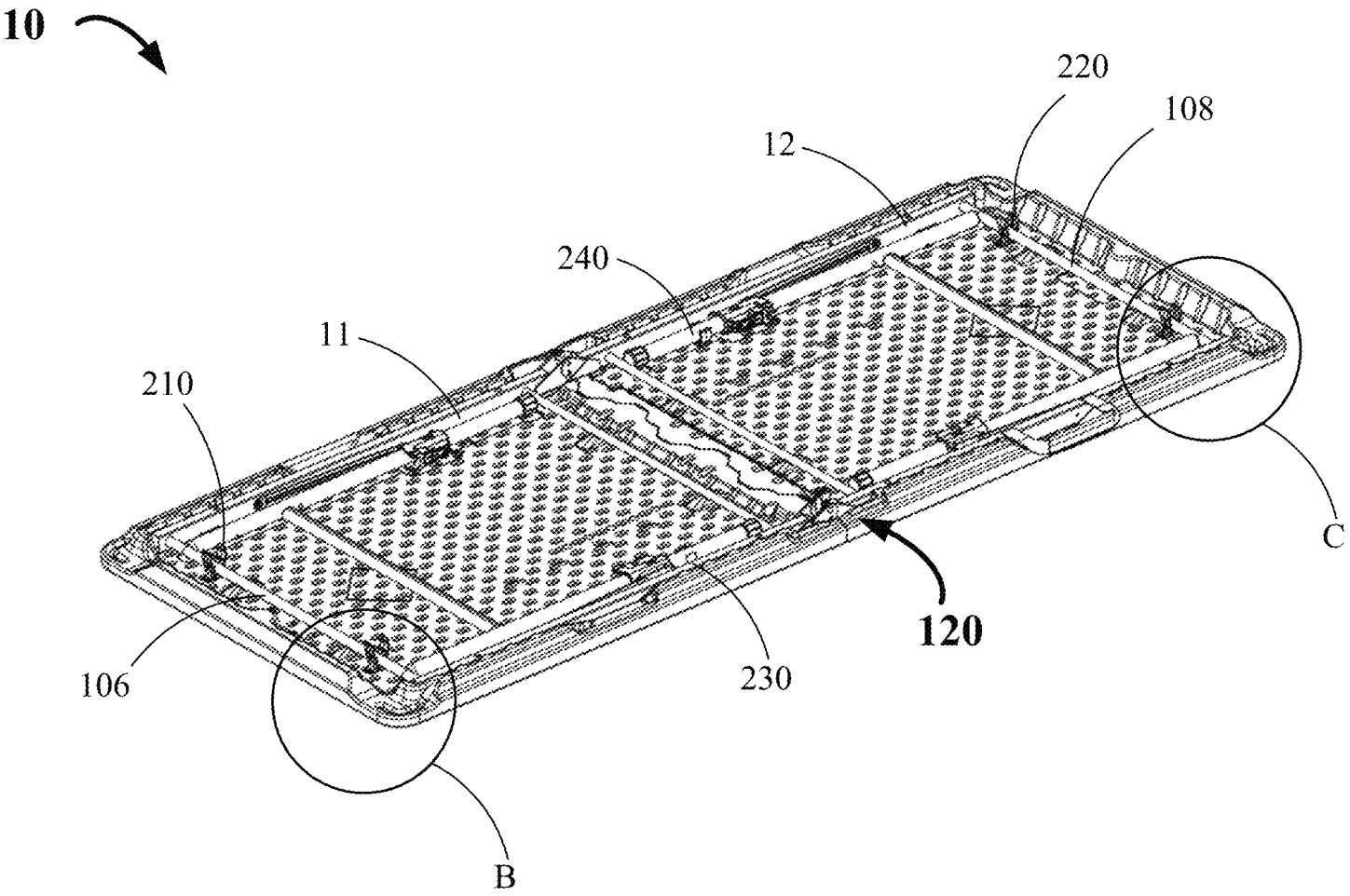
FIG. 2A is a bottom perspective view illustrating an exemplary table in an intermittent state in accordance with exemplary embodiments of the present disclosure.

In some exemplary embodiments, of at least one of the first and second longitudinal bars, the first and second bars are pivotally connected with each other by a folding/unfolding mechanism. For instance, by way of example, FIGS. 1 and 2A illustrate the first and second bars of second longitudinal bar 104 are pivotally connected with each other by folding/unfolding mechanism 120.

Figure 10:
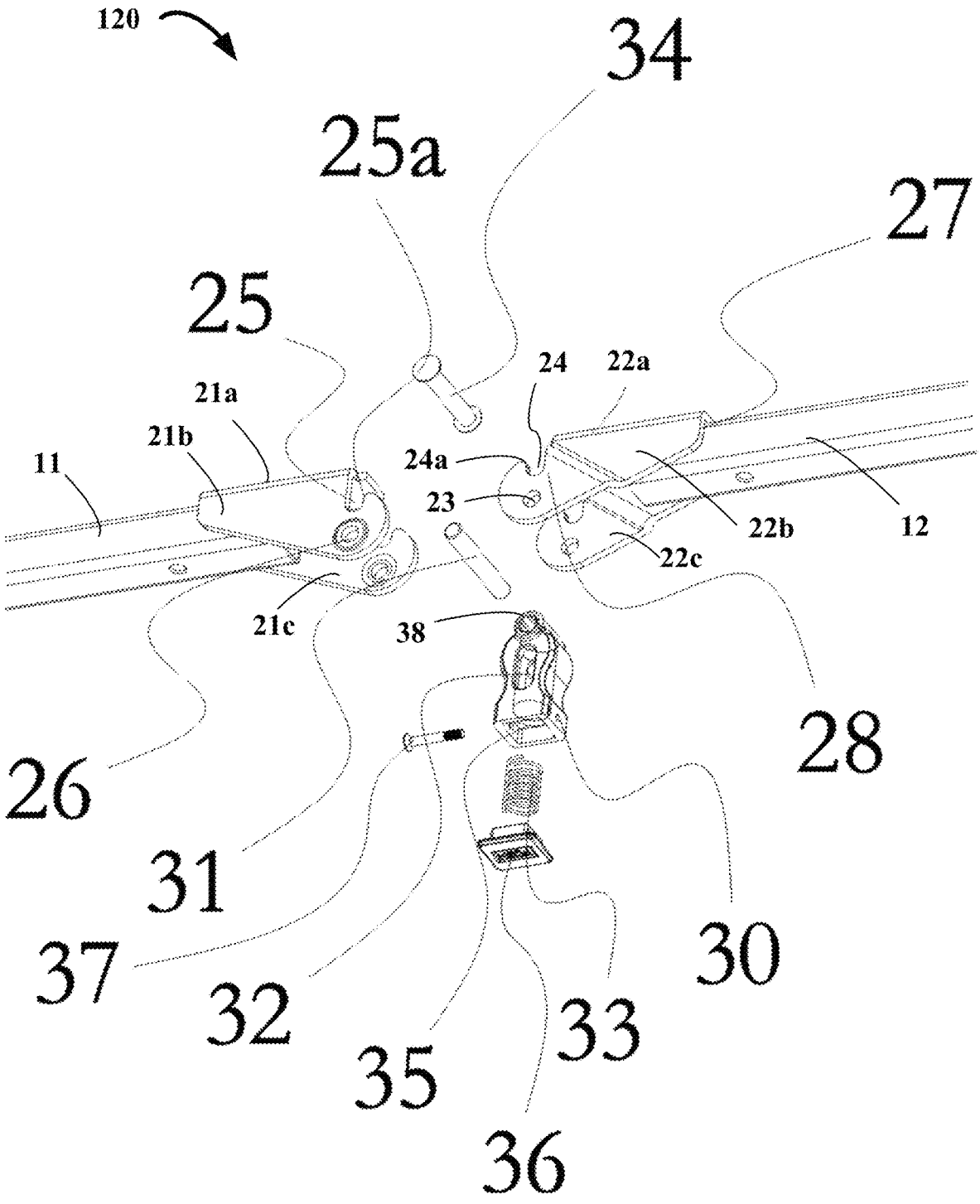
FIG. 10 is a partially disassembled view illustrating an exemplary folding/unfolding mechanism in a folded state in accordance with exemplary embodiments of the present disclosure.

Referring to FIG. 10, folding/unfolding mechanism 120 includes a first coupling piece such as first coupling piece 21, a second coupling piece such as second coupling piece 22, a third coupling piece such as third coupling piece 30, and two rods such as rod 31 and rod 34. First coupling piece 21 is configured to be fixedly coupled with first bar 11 at an end of the first bar, for instance, by welding, bolting or the like. Second coupling piece 22 is configured to be fixedly coupled with second bar 12 at an end of the second bar, for instance, by welding, bolting or the like. The first and second bars can be configured the same of differently, e.g., having the same or different lengths, shapes, sizes, or made of the deficient materials. By way of illustration, FIG. 10 shows the first and second bars having substantially the same shape.

In some exemplary embodiments, first coupling piece 21 is formed with a hole such as hole 26 and a slot such as slot 25 above hole 26 (not necessarily directly above; it can have an offset in the vertical or horizontal direction or in both directions). Slot 25 has a closed bottom and an open top. Similarly, in some exemplary embodiments, second coupling piece 22 is formed with a hole such as hole 23 and a slot such as slot 24 above hole 23 (not necessarily directly above; it can have an offset in the vertical or horizontal direction or in both directions). Slot 24 has a closed bottom and an open top.

Third coupling piece 30 is formed with a slot such as slot 32. Slot 32 has a closed bottom and a closed top. In some exemplary embodiments, the first, second and third coupling pieces are connected with each other by rod 34 that passes through hole 26 of the first coupling piece, hole 23 of the second coupling piece, and slot 32 of the third coupling piece. Such a connection allows the first and second coupling pieces to rotate with respect to each other around rod 34, and allows the third coupling piece to move with respect to rod 34 between a first position where rod 34 is at the bottom of slot 32 of the third coupling piece and a second position where rod 34 is at the top of slot 32 of the third coupling piece.

Rod 31 is integrally formed or coupled with a top portion of third coupling piece 30, and movable together with the third coupling piece. For instance, in an exemplary embodiment, third coupling piece 30 is formed with a hole such as hole 38, and rod 31 is coupled with the third coupling piece by passing through hole 38 of the third coupling piece. Moving third coupling piece 30 with respect to rod 34 can place rod 31 into slot 25 of the first coupling piece and slot 24 of the second coupling piece, or release rod 31 from slot 25 of the first coupling piece or from slot 24 of the second coupling piece or from both of slot 25 of the first coupling piece and slot 24 of the second coupling piece. When rod 31 is disposed in both of slot 25 of the first coupling piece and slot 24 of the second coupling piece, the first and second coupling pieces are restricted from rotating with respect to each other. When rod 31 is released from one or more of slot 25 of the first coupling piece and slot 24 of the second coupling piece, the first and second coupling pieces are rotatable with respect to each other.

In some exemplary embodiments, the open top of slot 25 is curved, e.g., including curved edge 25*a*, and the open top of slot 24 is curved, e.g., including curved edge 24*a*. This configuration facilitates easy insertion of rod 31 into slot 24 and slot 25 and easy release of rod 31 from slot 24 and slot 25.

In some exemplary embodiments, first coupling piece 21 includes a horizontal piece such as horizontal piece 21*a*, a first lug such as first lug 21*b* at a first side of the horizontal piece and a second lug such as second lug 21*c* at a second side of the horizontal piece. The first and second lugs of the first coupling piece are substantially parallel to each other, and each is formed with a hole such as hole 26 and a slot such as slot 25. Similarly, in some exemplary embodiments, second coupling piece 22 includes a horizontal piece such as horizontal piece 22*a*, a first lug such as first lug 22*b* at a first side of the horizontal piece and a second lug such as second lug 22*c* at a second side of the horizontal piece. The first and second lugs of the second coupling piece are substantially parallel to each other, and each is formed with a hole such as hole 23 and a slot such as slot 24.

In some exemplary embodiments, at proximal end portions of the first and second coupling pieces, a distance between the first and second lugs of the first coupling piece is smaller than a distance between the first and second lugs of the second coupling piece. For instance, in an exemplary embodiment, proximal portions 28 of the first and second lugs of the second coupling piece are bended outwardly with respect to distal portions 27 of the first and second lugs of the second coupling piece such that a distance between proximal portions 28 is wider than a distance between distal portions 27. In such embodiments, at least a portion of the first and second lugs of the first coupling piece is disposed between the first and second lugs of the second coupling piece, and at least a portion of the third coupling piece is disposed between the first and second lugs of the first coupling piece, and at least a portion of the first and second lugs of the first coupling piece is disposed between the first and second lugs of the second coupling piece.

In some exemplary embodiments, third coupling piece 30 is formed with a cavity such as cavity 35. Elastic member 33 (e.g., spring) is disposed in the cavity and enclosed by a cover such as cover 36. Cover 36 is coupled with the third coupling piece, for instance, by a fastener such as fastener 37 or by snap fitting or the like. When assembled, elastic member 33 is disposed between rod 34 and cover 36, and has one end abutting rod 34 and another end abutting cover 36. Under normal conditions (e.g., without an external force), the third coupling piece is generally positioned by the elastic force of elastic member 33 at the second position where rod 34 is disposed at the top of slot 32 of the third coupling piece. An external force (e.g., by pushing or pressing the cover or the third coupling piece) is required to move the third coupling piece from the second position toward the first position, where rod 34 is disposed at the bottom of slot 32 of the third coupling piece.

Folding/unfolding mechanism 120 selectively allows the first and second bars (and thus selectively allows the table) to fold and unfold. For instance, from the unfolded state, one can push third coupling piece 30 toward the slots of the first and second coupling pieces. Since it moves along with third coupling piece 30, rod 31 is pushed towards the open tops of the slots of the first and second coupling pieces, and eventually released from slot 25 of the first coupling piece or from slot 24 of the second coupling piece or from both of the slots of the first and second coupling pieces. This unlocks the first and second coupling pieces, and thus allows the first and second coupling pieces (accordingly the first and second bars) to rotate freely around rod 34. At the folded state, elastic member 33 abuts cover 36 and thus pulls the third coupling piece back such that rod 31 is disposed at the closed bottom of slot 25 of the first coupling piece, or at the closed bottom of slot 24 of the second coupling piece. To unfold the first and second bars, one can rotate one or more of the first and second bars and then push the third coupling piece. When the slots of the first and second bars are aligned with each other, release the third coupling piece. Due to the elastic force of elastic member 33, the third coupling piece is pulled back such that rod 31 is inserted into slot 25 of the first coupling piece and slot 24 of the second coupling piece. This locks the first and second coupling pieces and thus restricts the first and second bars from rotating with respect to each other.

Referring back to FIGS. 1-4, frame 100 also includes a first lateral bar such as first lateral bar 106 disposed at a third side of the frame and a second lateral bar such as second lateral bar 108 disposed at a fourth side of the frame. Each of the first and second lateral bars has a first end pivotally connected with the first longitudinal bar and a second end pivotally connected with the second longitudinal bar.

In some exemplary embodiments, frame 100 includes a plurality of first legs such as legs 132 and a plurality of second legs such as legs 134. Each first leg has an end fixedly connected with the first lateral bar and each second leg has an end fixedly connected with the second lateral bar. For instance, in an exemplary embodiment, frame 100 includes two first legs connected with the first lateral bar and two second legs connected with the second lateral bar. In an exemplary embodiment, the length of the first and second legs is adjustable, for instance, by having an upper leg and a lower leg that are telescopically connected with each other. Examples of such adjustable legs are disclosed in Chinese Utility Model Applications CN 201921680600.1 filed Oct. 9, 2019 and CN 201921686275.X filed Oct. 9, 2019. The disclosure of each application is incorporated herein for all purposes by reference in its entirety. With adjustable legs, the table can be placed at different heights to meet different needs of different users.

In some exemplary embodiments, frame 100 includes one or more leg lateral bars such as first leg lateral bar 136 and second leg lateral bar 138. First leg lateral bar 136 is disposed between and fixedly connected with the two first legs that are connected with the first lateral bar, and second leg lateral bar 138 is disposed between and fixedly connected with the two second legs that are connected with the second lateral bar.

To enhance the strength and stability of the table, in some exemplary embodiments, frame 100 includes a plurality of oblique bars such as oblique bar 150 and a plurality of sliders such as slider 140. For instance, in an exemplary embodiment, frame 100 includes four oblique bars 150 and four sliders 140. Slider 140 can be coupled with the first or second leg or coupled with the first or second longitudinal bar. By way of example, FIGS. 1-3 illustrate slider 140 slidably coupled with the first or second leg. In such an exemplary embodiment, oblique bar 150 has one end pivotally connected with a corresponding first or second longitudinal bar and the other end pivotally connected with a corresponding slider that is slidably coupled with a corresponding first or second leg. In an alternative exemplary embodiment, each oblique bar 150 has one end pivotally connected with a corresponding first or second leg and the other end pivotally connected with a corresponding slider that is slidably coupled with a corresponding first or second longitudinal bar.

In some exemplary embodiments, slider 140 includes a controller such as controller 142 configured to selectively allow the slider to move along the first and second leg or restrict the slider from moving along the first and second leg. Examples of such sliders are disclosed in Chinese Utility Model Applications CN 201921680600.1 filed Oct. 9, 2019, CN 201921686275.X filed Oct. 9, 2019, and CN 201921680806.4 filed Oct. 9, 2019. The disclosure of each application is incorporated herein for all purposes by reference in its entirety.

In some exemplary embodiments, each slider 140 is disposed at the corresponding leg below first leg lateral bar 136 or second leg lateral bar 138 (FIG. 1 shows the sliders above first leg lateral bar 136 or second leg lateral bar 138 because it is a bottom perspective view of the table). In such embodiments, each of first leg lateral bar 136 and second leg lateral bar 138 serves as a stopper and prevents the corresponding slider from moving further toward the top of the leg. As a result, this prevents the plurality of legs from rotating beyond its unfolded state.

It should be noted that slider 140 can couple with any suitable bars or legs including but not limited to the first and second longitudinal bars and the first and second legs disclosed herein, and accordingly slider 140 can be used in applications including but not limited to table frames disclosed herein. For instance, slider 140 can be used in other furniture such as chairs, beds or the like.

Figure 2B:
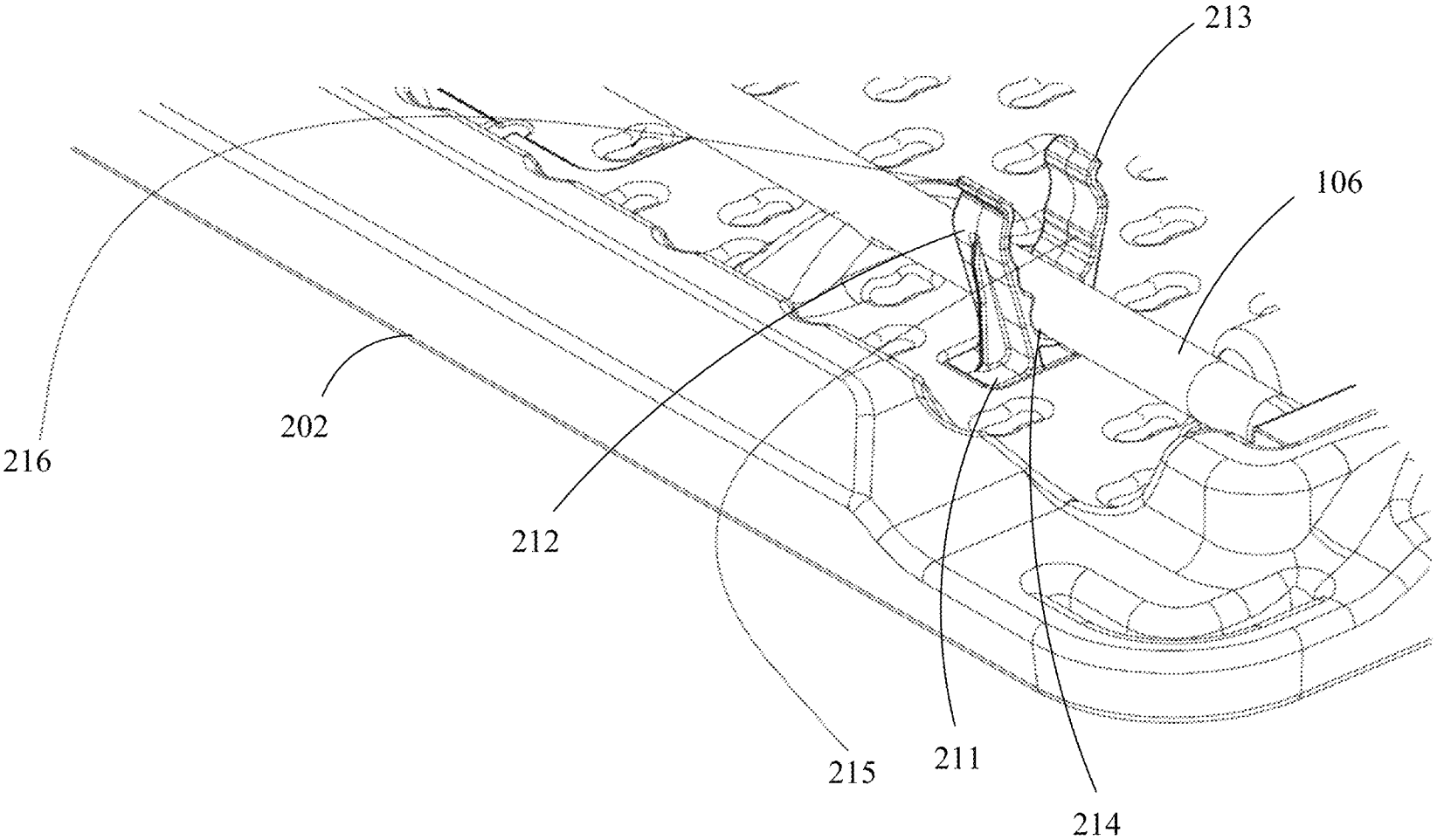
FIG. 2B is an enlarged view taken along circle B of FIG. 2A.
Figure 2C:
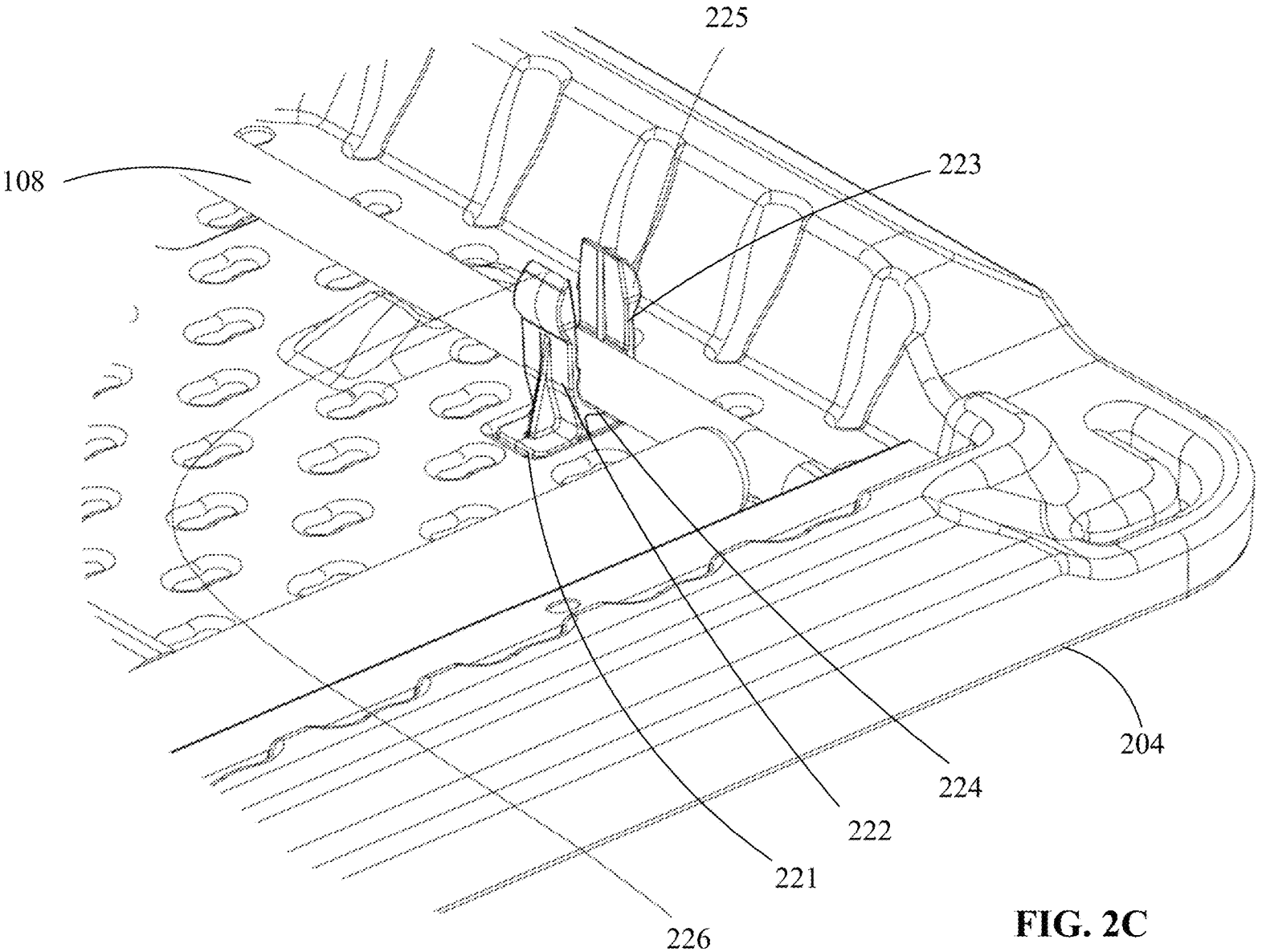
FIG. 2C is an enlarged view taken along circle C of FIG. 2A.
Figure 3:
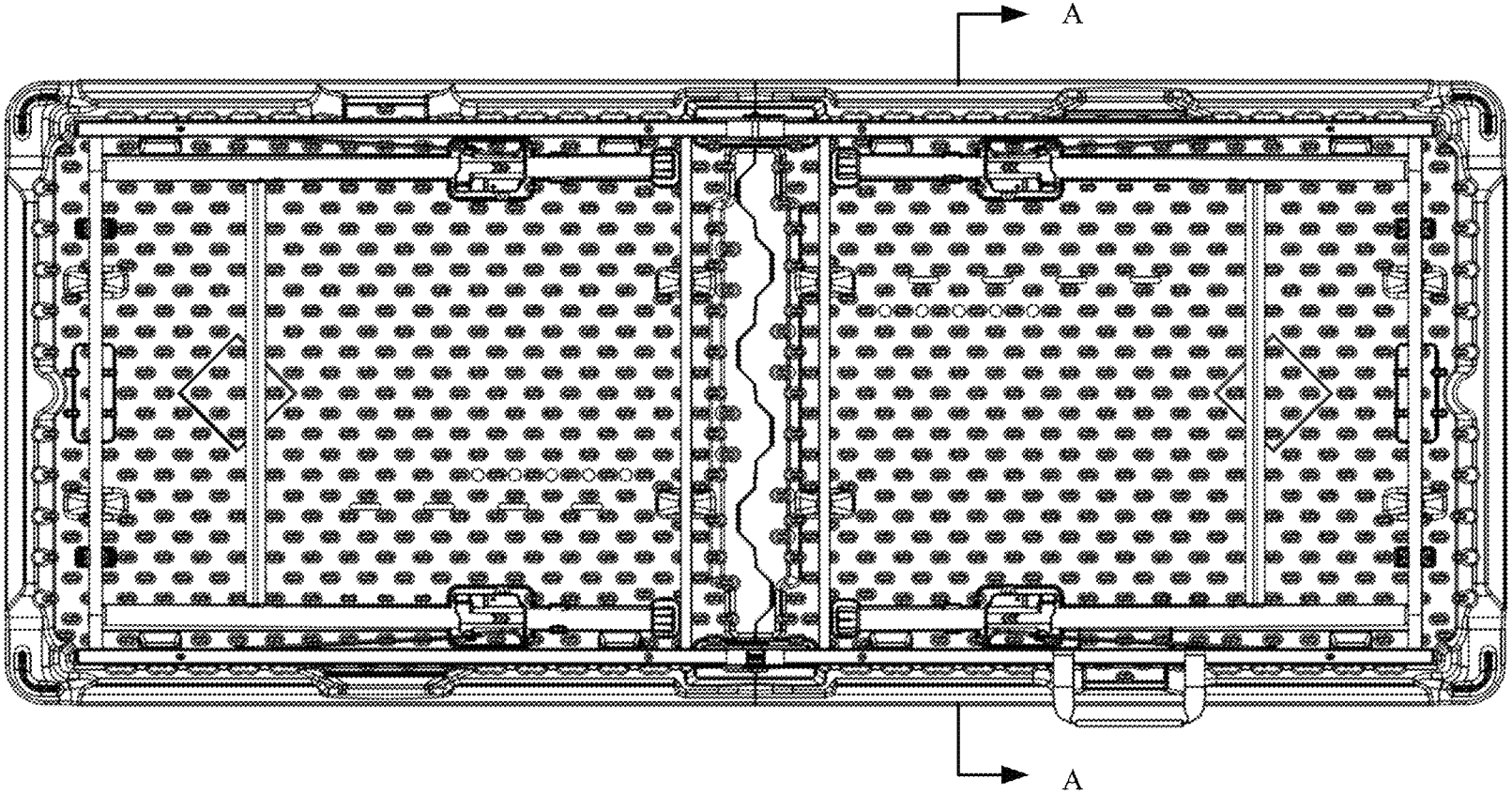
FIG. 3 is a bottom view illustrating an exemplary table in an intermittent state in accordance with exemplary embodiments of the present disclosure.
Figure 4:
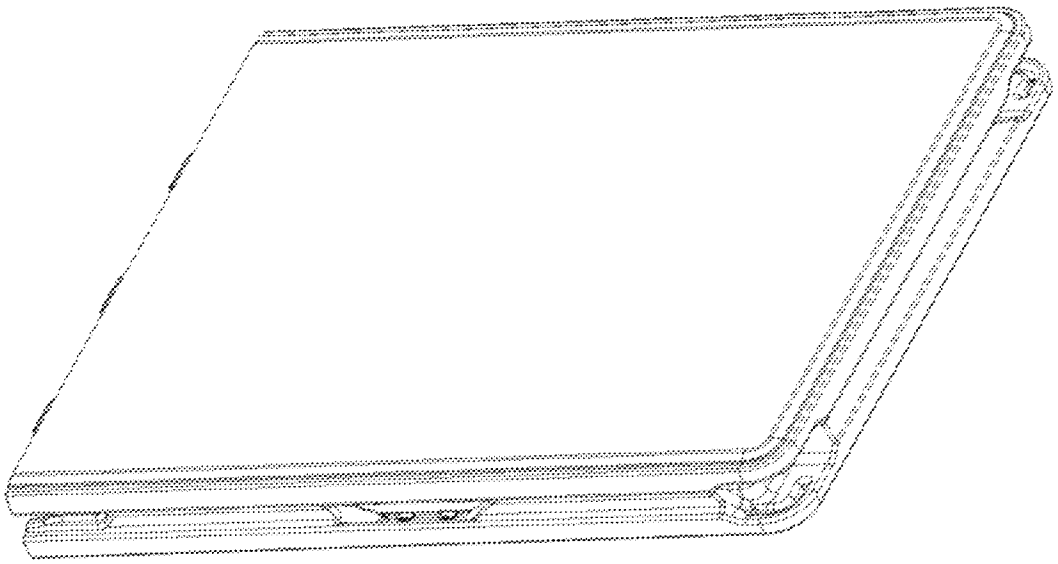
FIG. 4 is a perspective view illustrating an exemplary table in a folded state in accordance with exemplary embodiments of the present disclosure.
Figure 5:
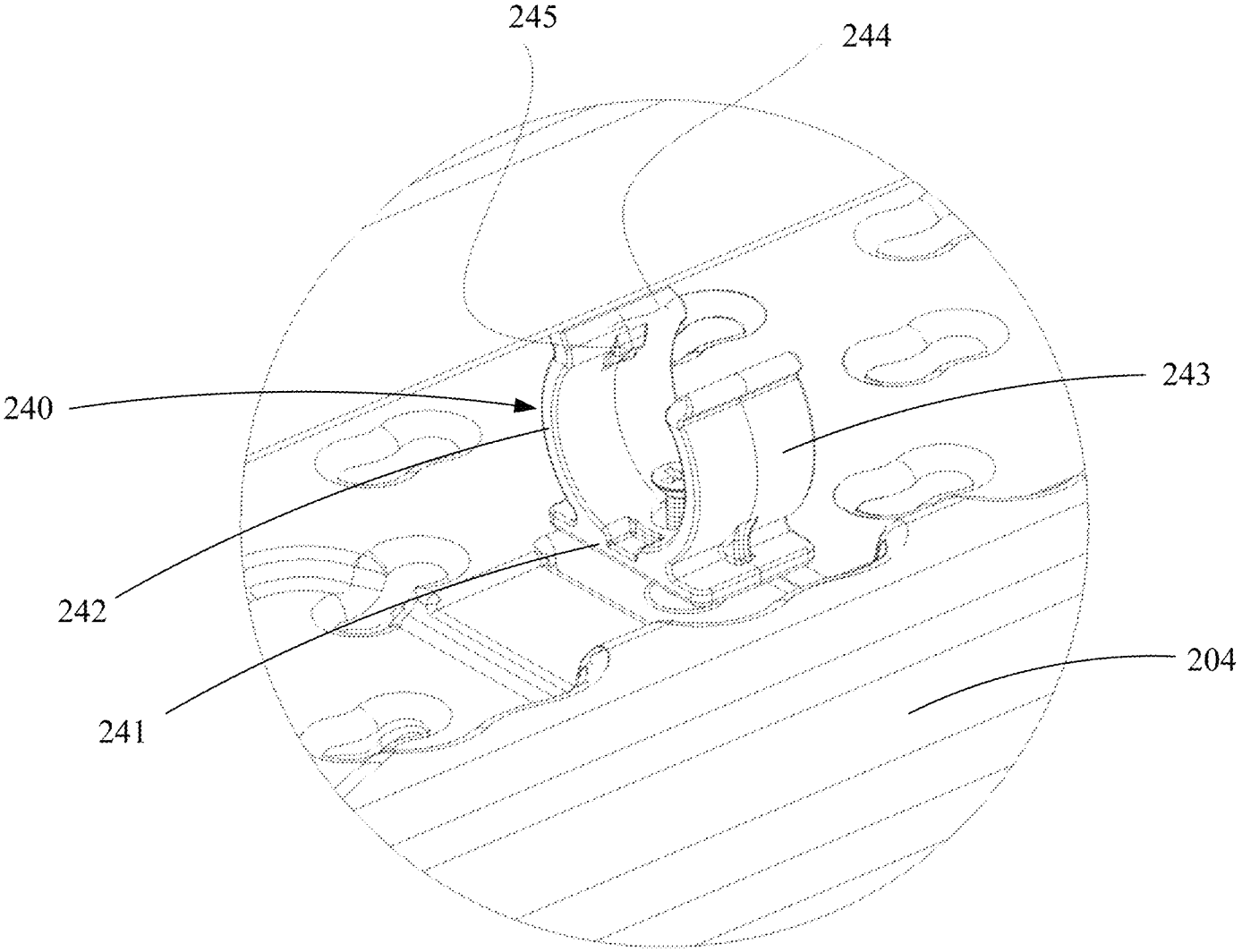
FIG. 5 is an enlarged view taken along circle A of FIG. 1.
Figure 6A:
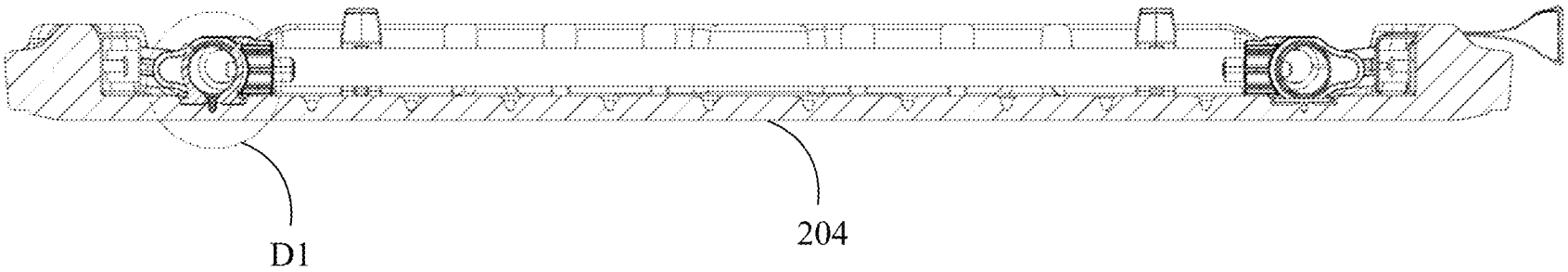
FIG. 6A is a representative cross-sectional view taken along line A-A of FIG. 3, in which the entire cross-section of panel 204, including wall(s) and/or hollow interior(s) if any, is hatched to illustrate that panel 204 can be either a solid panel, a porous panel or a panel with one or more hollow interiors.
Figure 6B:
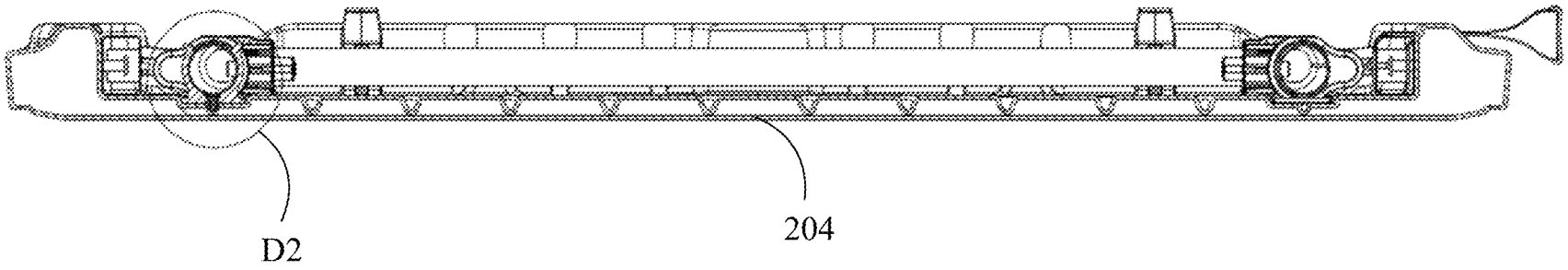
FIG. 6B is another representative cross-sectional view taken along line A-A of FIG. 3, in which panel 204 is a panel with a hollow interior.
Figure 7A:
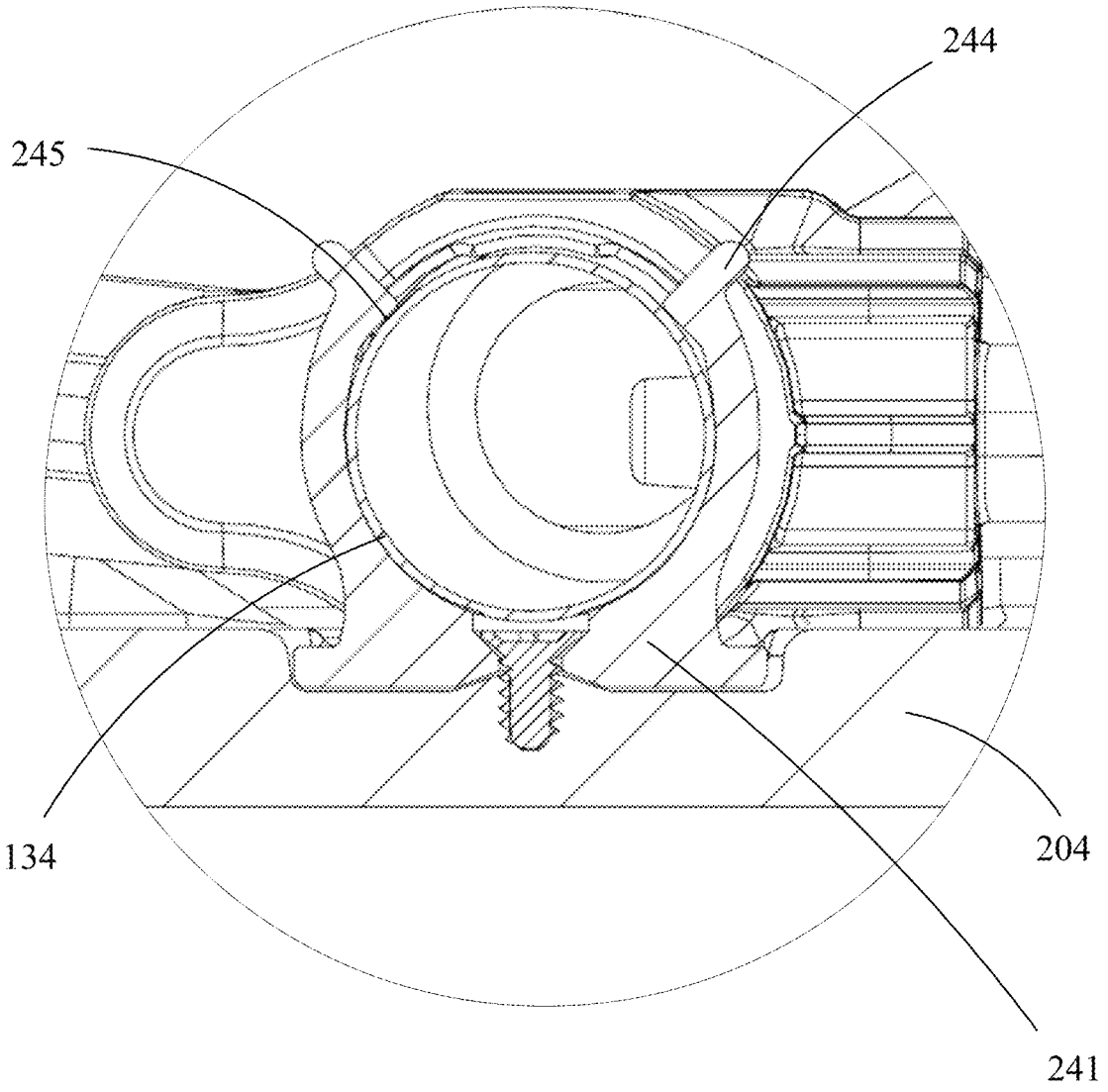
FIG. 7A is an enlarged view taken along circle D1 of FIG. 6A.
Figure 7B:
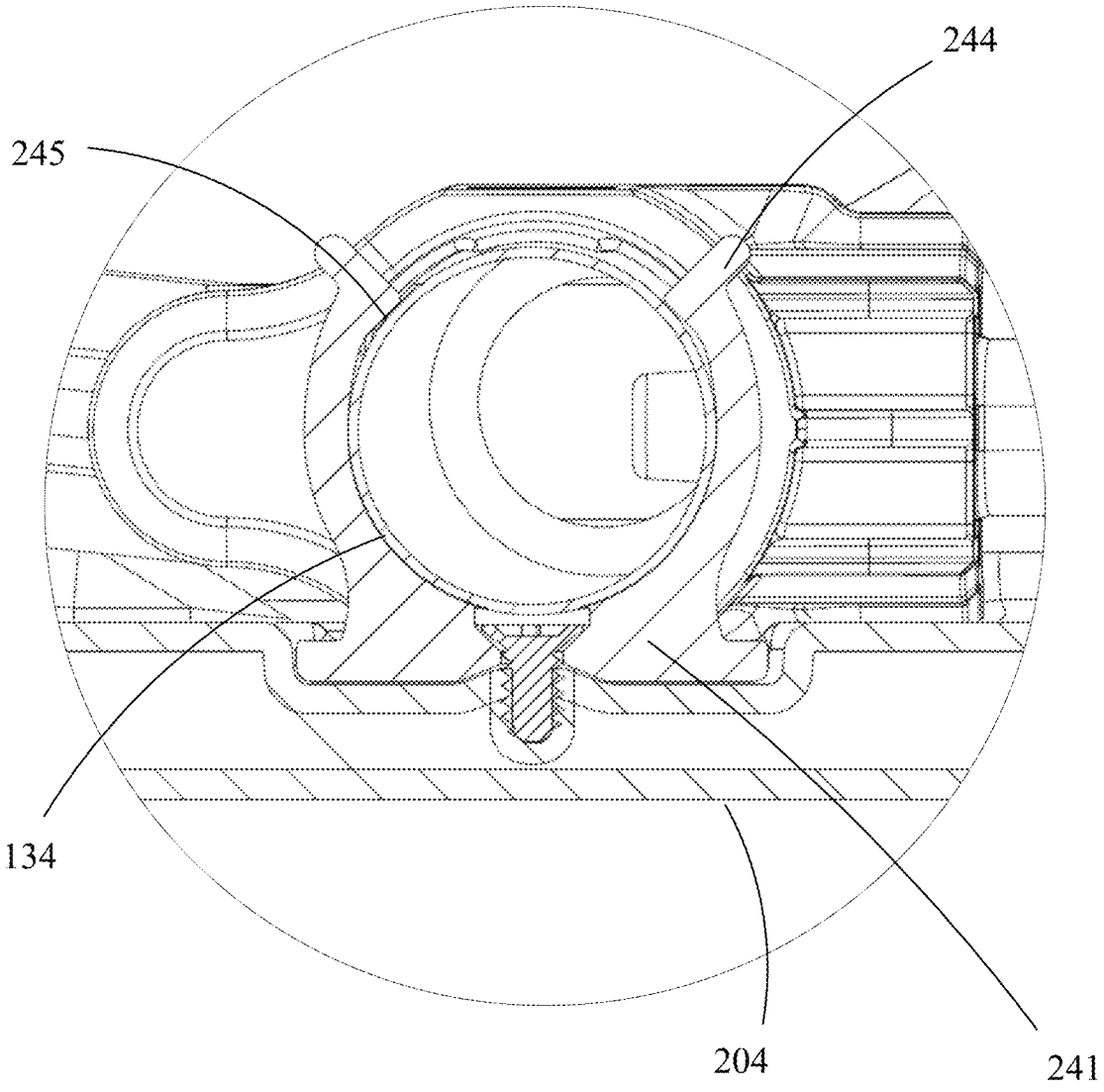
FIG. 7B is an enlarged view taken along circle D2 of FIG. 6B.
Figure 8:
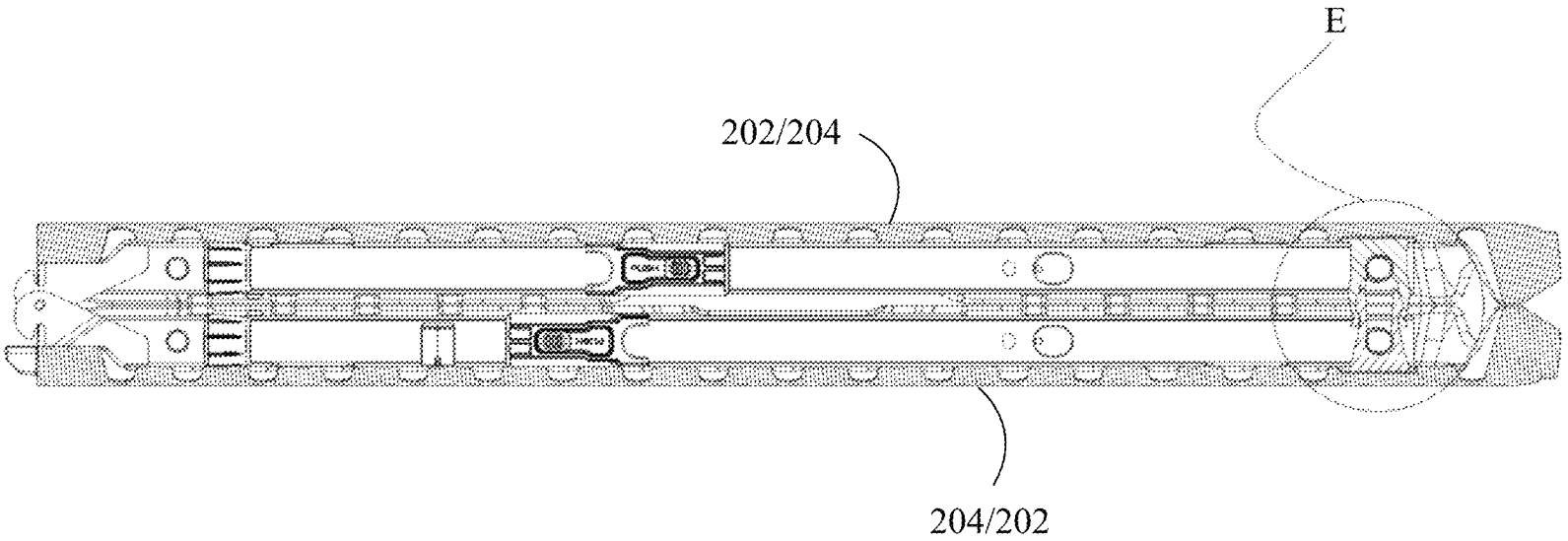
FIG. 8 is a cross-sectional view illustrating an exemplary table in a folded state in accordance with exemplary embodiments of the present disclosure, in which the entire cross-section of panel 202 or 204, including wall(s) and/or hollow interior(s) if any, is hatched to illustrate that panel 202 or 204 can be either a solid panel, a porous panel or a panel with one or more hollow interiors.

Referring still to FIGS. 1-4, tabletop 200 includes a first panel such as first panel 202 and a second panel such as second panel 204. The first panel is coupled with the first bars of the first and second longitudinal bars, and the second panel coupled with the second bars of the first and second longitudinal bars. As such, table 10 is foldable, and in embodiments with folding/unfolding mechanism 120, the folding and unfolding of table 10 is controlled by folding/unfolding mechanism 120. In some exemplary embodiments, the first and second panels are substantially the same, and can be folded onto each other as illustrated in FIG. 4 with the legs in between. As shown, the folded size of the table is reduced to approximately half of the unfolded size. As such, the table when folded requires less storage space, is easy to transport, and presents good aesthetic appearance.

Referring to FIGS. 2A-2C and 8-9, to maintain the folding state, tabletop 200 includes one or more first retainers such as retainer 210 integrally formed or coupled with the first panel at the third side of the table and one or more second retainers such as retainer 220 integrally formed or coupled with the second panel at the fourth side of the table. By way of example, FIG. 2A illustrates two retainers 210 disposed spatially along a lateral direction of the table, and two retainers 220 disposed spatially along the lateral direction of the table. The first and second retainers are configured such as when the first and second panels are rotated onto each other, the first and second retainers are engaged (e.g., snap-fitted) with each other, thereby locking the table in the folded state.

For instance, in some exemplary embodiments, retainer 210 includes a first base such as base 211 integrally formed (e.g., molded) or coupled (e.g., fastened) with the first panel of the tabletop. Retainer 210 also includes two first lever arms such as lever arm 212 and lever arm 214 that are extended from the first base. The proximal portions of the two first lever arms collectively form a first receiving portion such as receiving portion 214 to receive cross-section-wise the first lateral bar of the frame. The distal portions of the two first lever arms collectively form a first engaging portion such as engaging portion 215.

Similarly, retainer 220 includes a second base such as base 221 integrally formed (e.g., molded) or coupled (e.g., fastened) with the second panel of the tabletop. Retainer 220 also includes two second lever arms such as lever arm 222 and lever arm 224 that are extended from the second base. The proximal portions of the two second lever arms collectively form a second receiving portion such as receiving portion 224 to receive cross-section-wise the second lateral bar of the frame. The distal portions of the two second lever arms collectively form a second engaging portion such as engaging portion 225.

Engaging portion 215 and engaging portion 225 are configured to engage with each other to prevent accidental separation of the first and second panels from each other when the table is in the folded state. For instance, in some exemplary embodiments, the engagement is achieved by snap-fitting the distal portions of the lever arms of one retainer (e.g., the first or second retainer) between the distal portions of the lever arms of the other retainer when the table is folded.

Figure 9:
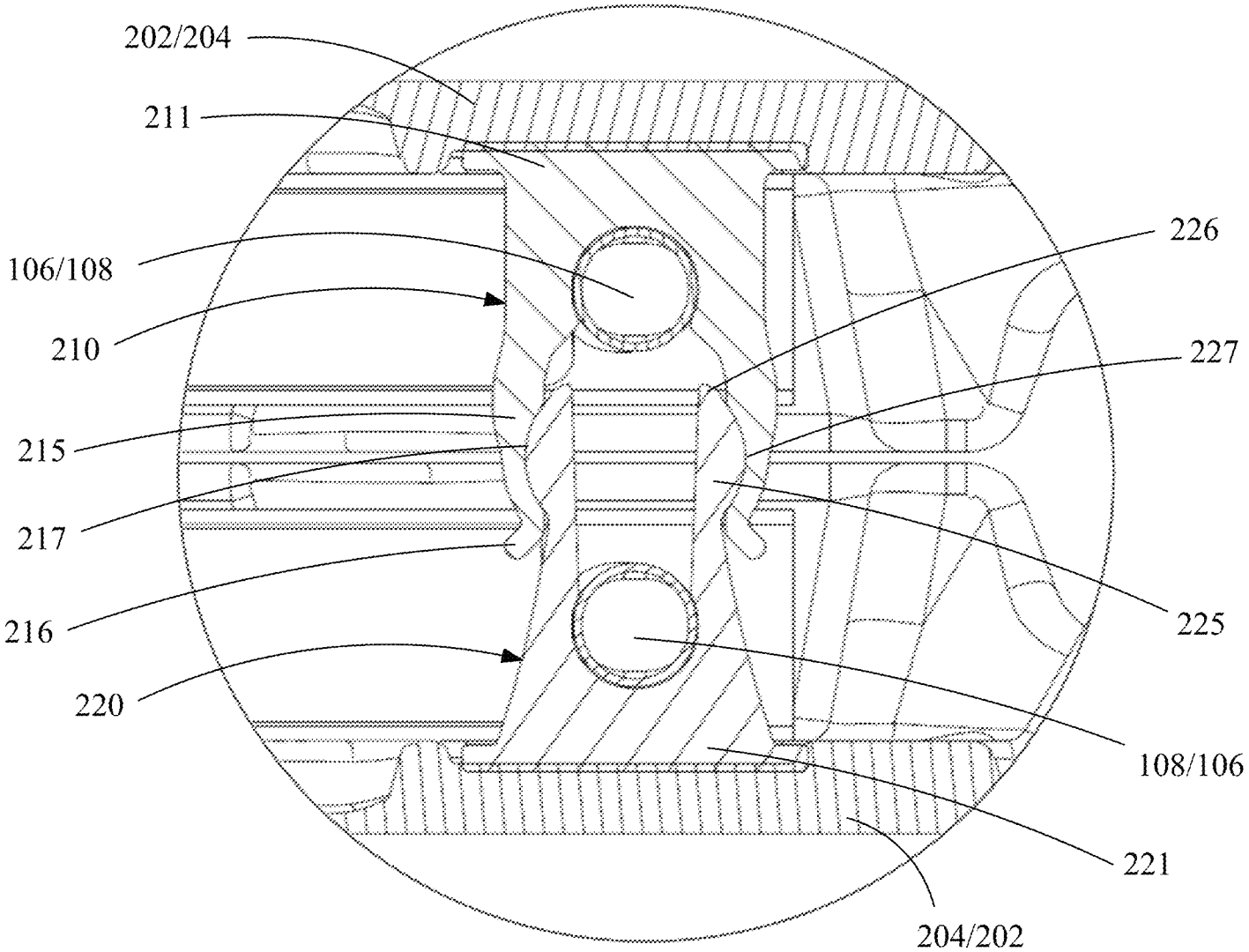
FIG. 9 is an enlarged view taken along circle E of FIG. 8.

As an example, FIG. 9 illustrates the distal portions of the two lever arms of retainer 220 snap-fitted between the distal portions of the two lever arms of retainer 210. In an exemplary embodiment, the distal portion of each lever arm of retainer 210 includes an outwardly curved end portion such as outwardly curved end portion 216 to aid the insertion of the two lever arms of retainer 220 in between the two lever arms of retainer 210. In an alternative exemplary embodiment, the distal portion of each lever arm of retainer 220 includes a pointed tip portion such as pointed tip portion 226 to aid the insertion of the two lever arms of retainer 220 in between the two lever arms of retainer 210. In another alternative exemplary embodiment, the distal portion of each lever arm of retainer 210 includes an outwardly curved end portion and the distal portion of each lever arm of retainer 220 includes a pointed tip portion to aid the insertion of the two lever arms of retainer 220 in between the two lever arms of retainer 210.

In some exemplary embodiments, the distal portion of each lever arm of retainer 210 is formed with a concave inner surface such as concave inner surface 217 and the distal portion of each lever arm of retainer 220 is formed with a convex outer surface such as convex outer surface 227. Concave inner surface 217 of retainer 210 and convex outer surface 227 of retainer 220 match with each other. As such, once the distal end portions of the lever arms of retainer 220 are inserted in between the distal end portions of the lever arms of retainer 210, the concave and convex surfaces cooperate with each other to prevent accidental separation of the lever arms of retainer 220 from the two lever arms of retainer 210 unless a certain amount of external force is applied.

While FIGS. 2A-2C illustrate retainer 210 as the first retainer integrally formed or coupled with the first panel and retainer 220 as the second retainer integrally formed or coupled with the second panel, it should be noted that retainer 210 can be used as either the first or second retainer and similarly retainer 220 can used as either the first or second retainer as long as they are paired together. For instance, in an exemplary embodiment, one or more retainers 220 are disposed at the third side of the table and one or more retainers 210 are disposed at the fourth side of the table. In such an embodiment, retainer 220 is integrally formed or coupled with the first panel (e.g., panel 202) and receives the first lateral bar (e.g., lateral bar 106) while retainer 210 is integrally formed or coupled with the second panel (e.g., panel 204) and receives the second lateral bar (e.g., lateral bar 108).

In another exemplary embodiment, at least one retainer 210 and at least one retainer 220 formed or coupled with the first panel, and at least one retainer 210 and at least one retainer 220 formed or coupled with the second panel. The retainers are arranged such that retainer 210 of the first panel engages with retainer 220 of the second panel when the first and second panels are folded onto each other, and vice versa.

Referring to FIGS. 1, 2A and 5-7, in some exemplary embodiments, tabletop 200 further includes a third retainer such as retainer 230 and a fourth retainer such as retainer 240. The third retainer is integrally formed or coupled with the first panel to receive cross-section-wise a first leg (e.g., leg 132) when the first leg is folded onto the tabletop. The fourth retainer is integrally formed or coupled with the second panel to receive cross-section-wise a second leg (e.g., leg 134) when the second leg is folded onto the tabletop. In some exemplary embodiments, the third and fourth retainers are disposed staggered with respect to each other, e.g., the third and fourth retainers are not aligned along the longitudinal direction of the table. For instance, in an exemplary embodiment, one of the third and fourth retainers is disposed at the first side of the table and the other of the third and fourth retainers is disposed at the second side of the table. By way of example, FIGS. 1-3 illustrate that retainer 230 is coupled with the first panel at the second side of the table and retainer 240 is coupled with the second panel at the first side of the table.

In some exemplary embodiments, each of the third and fourth retainers includes a base integrally formed or coupled with the first or second panel. Each of the third and fourth retainers also includes two lever arms extended from the base. For instance, FIGS. 5-7B illustrate retainer 240 having base 241, lever arm 242 and lever arm 243. Base 241 is coupled (e.g., fastened by a screw) with second panel 204. Lever arm 242 and lever arm 243 are extended from base 241 and collectively form a receiving portion that receives leg 134 (cross-section-wise) when leg 134 is folded onto panel 204 of the tabletop.

To aid insertion of the leg, in some exemplary embodiments, each of the two lever arms includes an outwardly curved end portion such as outwardly curved end portion 244 to aid insertion of the first or second leg. To help retain the leg, in some exemplary embodiments, at least one lever arm includes an inwardly protruded knob adjacent the outwardly curved end portion. For instance, by way of example, FIGS. 5-7B illustrates inwardly protruded knob 245 formed adjacent outwardly curved end portion 244 of lever arm 242.

Lever arm 242 and lever arm 243 are configured to be elastic and/or resilient to some extent such that when leg 134 is being pushed toward the receiving portion, lever arm 242 and lever arm 243 (or the end portions of the lever arms) will be pushed outwardly to allow the insertion of the leg. Once the leg is pushed into the receiving portion, lever arm 242 and lever arm 243 (or the end portions of the lever arms) will resume their normal shapes and/or positions, and thus hold and secure the leg in the receiving portion. Similarly, when leg 134 is being pulled from the receiving portion, lever arm 242 and lever arm 243 (or the end portions of the lever arms) will be pushed outwardly to release the leg. Once the leg is pulled out of the receiving portion, lever arm 242 and lever arm 243 (or the end portions of the lever arms) will resume their normal shapes and/or positions.

The third and fourth retainers can be configured the same as or differently from each other. By way of example, FIGS. 1 and 2A illustrates retainer 230 and retainer 240 being configured substantially the same. When the legs are folded onto the first and second panels of the tabletop, the third and fourth retainers engage with the legs and hold the legs in position. By holding the legs in position, the third and fourth retainers help to reduce the force on the first and second retainers when the first and second panels of the tabletop are folded onto each other and thus help to maintain the table in the folded state.

In some exemplary embodiments, table 10 includes additional, optional or alternative features. For instance, in some exemplary embodiments such as those illustrated in FIGS. 1 and 2A, frame 100 includes one or more interior lateral bars such as interior lateral bar 110 spaced apart from the first and second lateral bars. Each interior lateral bar has a first end connected with the first longitudinal bar and a second end connected with the second longitudinal bar. In some exemplary embodiments, corresponding to an interior lateral bar in the one or more interior lateral bars, tabletop 200 includes one or more slots/supports such as slot/support 206 to receive the interior lateral bar.

The tables of the present disclosure have several advantages. For instance, they require no substantial assembling by end users. The legs can be folded or unfolded by the control of the sliders. The first and second panels can be folded onto each other with the legs in between, thereby reducing the folded sizes of the tables to approximately half. As such, the folded tables require less storage space and present good aesthetic appearance. Further, when folded, the first and second retainers are engaged with each other, thereby locking the table in the folded state. The table will remain in the folded state unless a certain amount of external force is applied. In addition, when folded, the third and fourth retainers engage with the legs and retain the legs in position. As such, the third and fourth retainers help to reduce the force on the first and second retainers and thus help to maintain the tables in the folded state.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A table comprising:

a frame comprising:

a first longitudinal bar disposed at a first side of the table;

a second longitudinal bar disposed at a second side of the table and substantially parallel to the first longitudinal bar;

a first lateral bar disposed at a third side of the table and having a first end pivotally connected with the first longitudinal bar and a second end pivotally connected with the second longitudinal bar; and a second lateral bar disposed at a fourth side of the table and having a first end pivotally connected with the first longitudinal bar and a second end pivotally connected with the second longitudinal bar, wherein each of the first and second longitudinal bars comprises a first bar and a second bar pivotally connected with each other; and a tabletop coupled with the frame and supported by the frame when in use, the tabletop comprising:

a first panel coupled with the first bars of the first and second longitudinal bars;

a second panel coupled with the second bars of the first and second longitudinal bars;

one or more first retainers integrally formed or coupled with the first panel at the third side of the table, wherein each first retainer in the one or more first retainers comprises a first receiving portion and a first engaging portion, wherein the first receiving portion receives cross-section-wise the first lateral bar of the frame; and one or more second retainers integrally formed or coupled with the second panel at the fourth side of the table, wherein each second retainer in the one or more second retainers comprises a second receiving portion and a second engaging portion, wherein the second receiving portion receives cross-section-wise the second lateral bar of the frame, wherein when the table is in a folded state, the first engaging portion of each respective first retainer in the one or more first retainers engages with the second engaging portion of a corresponding second retainer in the one or more second retainers, thereby retaining the table in the folded state.

2. The table of claim 1, wherein the respective first retainer comprises:

a first base integrally formed or coupled with the first panel of the tabletop; and two first lever arms extended from the first base, wherein proximal portions of the two first lever arms collectively form the first receiving portion, and distal portions of the two first lever arms collectively form the first engaging portion; and the corresponding second retainer comprises:

a second base integrally formed or coupled with the second panel of the tabletop; and two second lever arms extended from the second base, wherein proximal portions of the two second lever arms collectively form the second receiving portion, and distal portions of the two second lever arms collectively form the second engaging portion.

3. The table of claim 2, wherein the distal portions of the two first lever arms of the respective first retainer are snap-fitted between the distal portions of the two second lever arms of the corresponding second retainer.

4. The table of claim 3, wherein the distal portion of each first lever arm comprises an outwardly curved end portion or the distal portion of each second lever arm comprises a pointed tip portion, thereby facilitating insertion of the distal portions of the two second lever arms of the corresponding second retainer between the distal portions of the two first lever arms of the respective first retainer.

5. The table of claim 3, wherein the distal portion of each first lever arm comprises a concave inner surface and the distal portion of each second lever arm comprises a convex outer surface that mates with the concave inner surface of the distal portion of each first lever arm, thereby facilitating retention of the distal portions of the two second lever arms of the corresponding second retainer in between the distal portions of the two first lever arms of the respective first retainer.

6. The table of claim 2, wherein the distal portions of the two second lever arms of the corresponding second retainer are snap-fitted between the distal portions of the two first lever arms of the respective first retainer.

7. The table of claim 6, wherein the distal portion of each second lever arm comprises an outwardly curved end portion or the distal portion of each first lever arm comprises a pointed tip portion, thereby facilitating insertion of the distal portions of the two first lever arms of the respective first retainer between the distal portions of the two second lever arms of the corresponding second retainer.

8. The table of claim 6, wherein the distal portion of each second lever arm comprises a concave inner surface and the distal portion of each first lever arm comprises a convex outer surface that mates with the concave inner surface of the distal portion of each second lever arm, thereby facilitating retention of the distal portions of the two first lever arms of the corresponding first retainer in between the distal portions of the two second lever arms of the respective second retainer.

9. The table of claim 1, wherein the one or more first retainers comprise two first retainers disposed spatially along a lateral direction of the table, and the one or more second retainers comprise two second retainers disposed spatially along the lateral direction of the table.

10. The table of claim 1, wherein the frame further comprises:

a plurality of first legs, each having an end fixedly connected with the first lateral bar; and a plurality of second legs, each having an end fixedly connected with the second lateral bar.

11. The table of claim 10, wherein the frame further comprises:

a plurality of sliders, each slidably coupled with a first leg in the plurality of first legs or a second leg in the plurality of second legs and selectively movable along the first or second leg; and a plurality of oblique bars, each having a first end pivotally connected with the first or second longitudinal bar, and a second end pivotally connected with a corresponding slider in the plurality of sliders.

12. The table of claim 11, wherein each slider in the plurality of sliders comprises:

a controller configured to selectively allow the slider to move along the first and second leg or restrict the slider from moving along the first and second leg.

13. The table of claim 10, wherein the tabletop further comprises:

a third retainer integrally formed or coupled with the first panel to receive cross-section-wise a first leg in the plurality of first legs when the first leg is folded onto the tabletop; and a fourth retainer integrally formed or coupled with the second panel to receive cross-section-wise a second leg in the plurality of second legs when the second leg is folded onto the tabletop.

14. The table of claim 13, wherein each of the third and fourth retainers comprises:

a base integrally formed or coupled with the first or second panel; and two lever arms extended from the base, wherein each of the two lever arms comprises an outwardly curved end portion, thereby facilitating insertion of the first or second leg; and at least one lever arm comprises an inwardly protruded knob adjacent the outwardly curved end portion, thereby facilitating retention of the first or second leg.

15. The table of claim 13, wherein the third and fourth retainers are disposed staggered with respect to each other.

16. The table of claim 15, wherein one of the third and fourth retainers is disposed at the first side of the table and the other of the third and fourth retainers is disposed at the second side of the table.

17. The table of claim 1, wherein for at least one of the first and second longitudinal bars, the first and second bars are pivotally connected with each other by a folding/unfolding mechanism comprising:

a first coupling piece fixed at a proximal end of the first bar, wherein the first coupling piece comprises a first hole and a first slot above the first hole, wherein the first slot has a closed bottom and an open top;

a second coupling piece fixed at a proximal end of the second bar, wherein the second coupling piece comprises a second hole and a second slot above the second hole, wherein the second slot has a closed bottom and an open top;

a third coupling piece comprising a third slot having a closed bottom and a closed top;

a first rod passing through the first hole of the first coupling piece, the second hole of the second coupling piece, and the third slot of the third coupling piece, wherein the first and second coupling pieces are rotatable with respect to each other around the first rod, and the third coupling piece is movable with respect to the first rod between a first position where the first rod is at the bottom of the third slot of the third coupling piece and a second position where the first rod is at the top of the third slot of the third coupling piece; and a second rod integrally formed or coupled with a top portion of the third coupling piece, and movable together with the third coupling piece, wherein when the second rod is disposed in both of the first slot of the first coupling piece and the second slot of the second coupling piece, the first and second coupling pieces are restricted from rotating with respect to each other, and when the second rod is released from any one of the first slot of the first coupling piece and the second slot of the second coupling piece, the first and second coupling pieces are rotatable with respect to each other.

18. The table of claim 17, wherein each of the first and second coupling pieces comprises a horizontal piece, a first lug at a first side of the horizontal piece and a second lug at a second side of the horizontal piece, wherein the first and second lugs are substantially parallel to each other; and each of the first and second lugs is formed with a corresponding first or second hole and a corresponding first or second slot.

19. The table of claim 17, wherein the third coupling piece comprises a third hole, wherein the second rod is coupled with the third coupling piece by passing through the third hole of the third coupling piece.

20. The table of claim 17, wherein the folding/unfolding mechanism further comprises:

an elastic member disposed in an interior of the third coupling piece between the first rod and a bottom cover of the third coupling piece, wherein the elastic member exerts a force on the first rod and the bottom cover of the third coupling piece, thereby positioning the third coupling piece at the second position where the first rod is at the top of the third slot of the third coupling piece.

* * * * *